US007066554B2

(12) United States Patent
Lin

(10) Patent No.: US 7,066,554 B2
(45) Date of Patent: Jun. 27, 2006

(54) CONTROL DEVICE HAVING A COLLAPSIBLE OPERATING HANDLE

(76) Inventor: Yu-Hong Lin, No. 15-1, Industry 3 Road, Tou Chiao Industrial Zone, Min Hsiung, Chayi (TW)

( * ) Notice: Subject to any disclaimer, the term of this patent is extended or adjusted under 35 U.S.C. 154(b) by 0 days.

(21) Appl. No.: 10/909,875

(22) Filed: Aug. 2, 2004

(65) Prior Publication Data

US 2006/0022508 A1 Feb. 2, 2006

(51) Int. Cl.

| | |
|---|---|
| ***A47C 1/024*** | (2006.01) |
| ***A47C 1/032*** | (2006.01) |
| ***A47C 1/038*** | (2006.01) |
| ***A47C 3/026*** | (2006.01) |

(52) U.S. Cl. ..... 297/463.1

(58) Field of Classification Search ..... 297/463.1, 297/463.2

See application file for complete search history.

(56) References Cited

U.S. PATENT DOCUMENTS

| | | | | |
|---|---|---|---|---|
| 2,683,328 | A * | 7/1954 | Thulin | 297/463.1 X |
| 5,427,434 | A * | 6/1995 | Hybarger | 297/301.4 |
| 6,174,031 | B1 * | 1/2001 | Lindgren et al. | 297/463.1 |
| 6,196,630 | B1 * | 3/2001 | Cheng | 297/344.22 |
| 6,598,936 | B1 * | 7/2003 | Klein | 297/301.2 |
| 6,619,740 | B1 * | 9/2003 | Beggs | 297/463.1 X |
| 2002/0096933 | A1 * | 7/2002 | Wang | 297/463.1 |

FOREIGN PATENT DOCUMENTS

| | | |
|---|---|---|
| TW | 283907 | 8/1996 |

* cited by examiner

*Primary Examiner*—Rodney B. White
(74) *Attorney, Agent, or Firm*—Alan D. Kamrath; Nikolai & Mersereau, P.A.

(57) ABSTRACT

A control device for use in a chair includes a casing fastened to the chair at the bottom side, a control rod pivoted to the casing, and an operating handle pivoted to the control rod and turnable between an operative position for rotation by the user to bias the control rod to further control rotation/lifting of the chair and a collapsed non-operative position to reduce space occupation of the chair for delivery.

6 Claims, 9 Drawing Sheets

CONTROL DEVICE HAVING A COLLAPSIBLE OPERATING HANDLE

BACKGROUND OF THE INVENTION

1. Field of the Invention

The present invention relates to a control device for a chair and, more particularly, to a control device having a collapsible operating handle.

2. Description of the Related Art

Taiwan patent publication no. 283907 discloses a chair back adjustment structure. According to this design, the chair comprises a seat frame supporting a seat, a back coupled to the seat by coupling means, an actuation cylinder installed in the seat, and a rotary control bar for rotation by the user to drive the actuation cylinder to tilt the back relative to the seat. According to this design, the rotary control bar has two ends respectively protruding over the two opposite lateral sides of the chair at a distance. During packing or delivery, the rotary control bar may be broken or damaged easily. Further, the protruding part of the rotary control bar greatly increases the packing size of the chair for delivery.

Therefore, it is desirable to provide an adjustment control device that eliminates the aforesaid problem.

SUMMARY OF THE INVENTION

The present invention has been accomplished under the circumstances in view. It is one object of the present invention to provide a control device for use in a chair to control a functional mechanism of the chair, which is collapsible to reduce space occupation of the chair for delivery. It is another object of the present invention to provide a control device which enables the user to collapse the operating handle preventing damage during packing or delivery.

To achieve these and other objects of the present invention, the control device comprises a casing installed in the bottom side of a chair, a control rod pivoted to the casing, and an operating handle pivoted to the control rod and turnable between an operative position for rotation by the user to bias the control rod to further control rotation/lifting of the chair and a collapsed non-operative position to reduce space occupation of the chair for delivery. In an alternate form of the present invention, two control rods are provided at two sides of the casing for a different function control, and two operating handles are respectively pivoted to the two control rods and turnable relative to the respective control rod between the operative position and the collapsed non-operative position.

DETAILED DESCRIPTION OF THE PREFERRED EMBODIMENT

Figure 1:
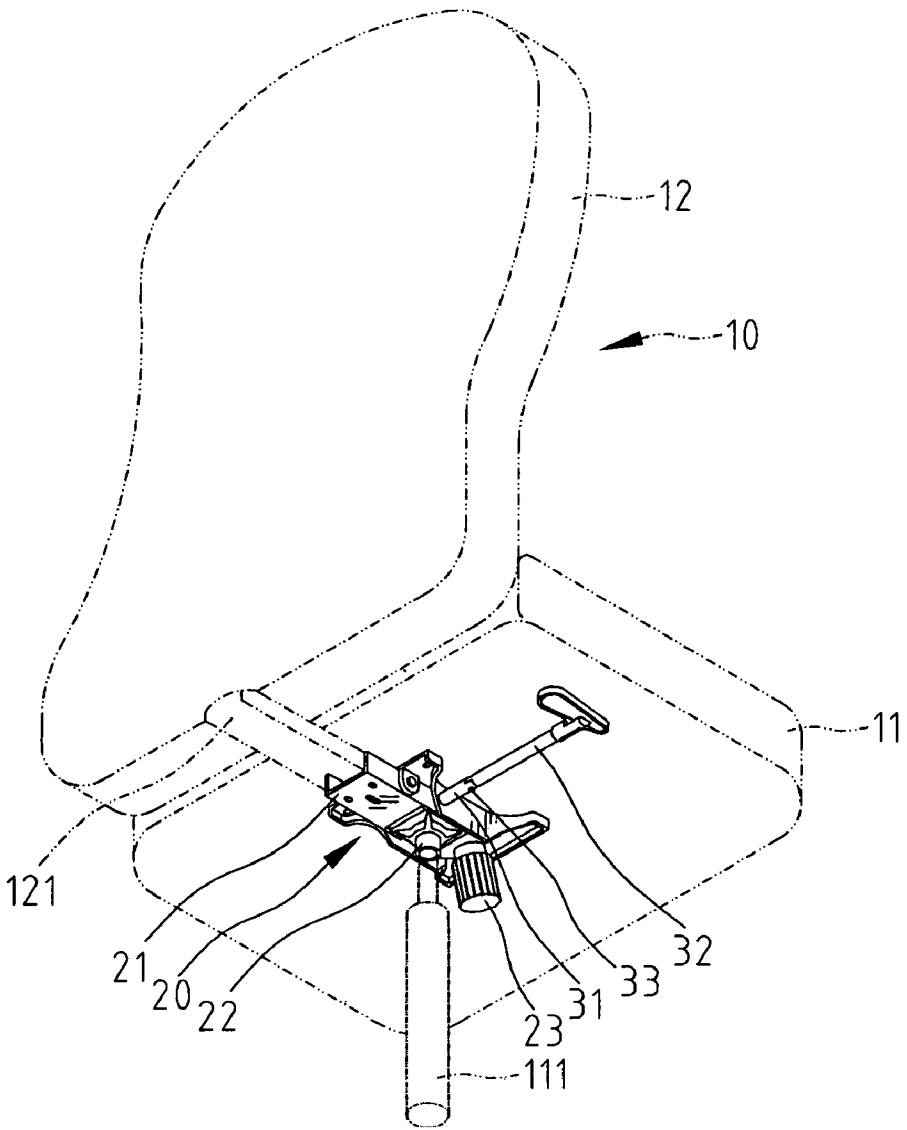
FIG. 1 is a schematic drawing showing a control device installed in a chair according to a first embodiment of the present invention.
Figure 2:
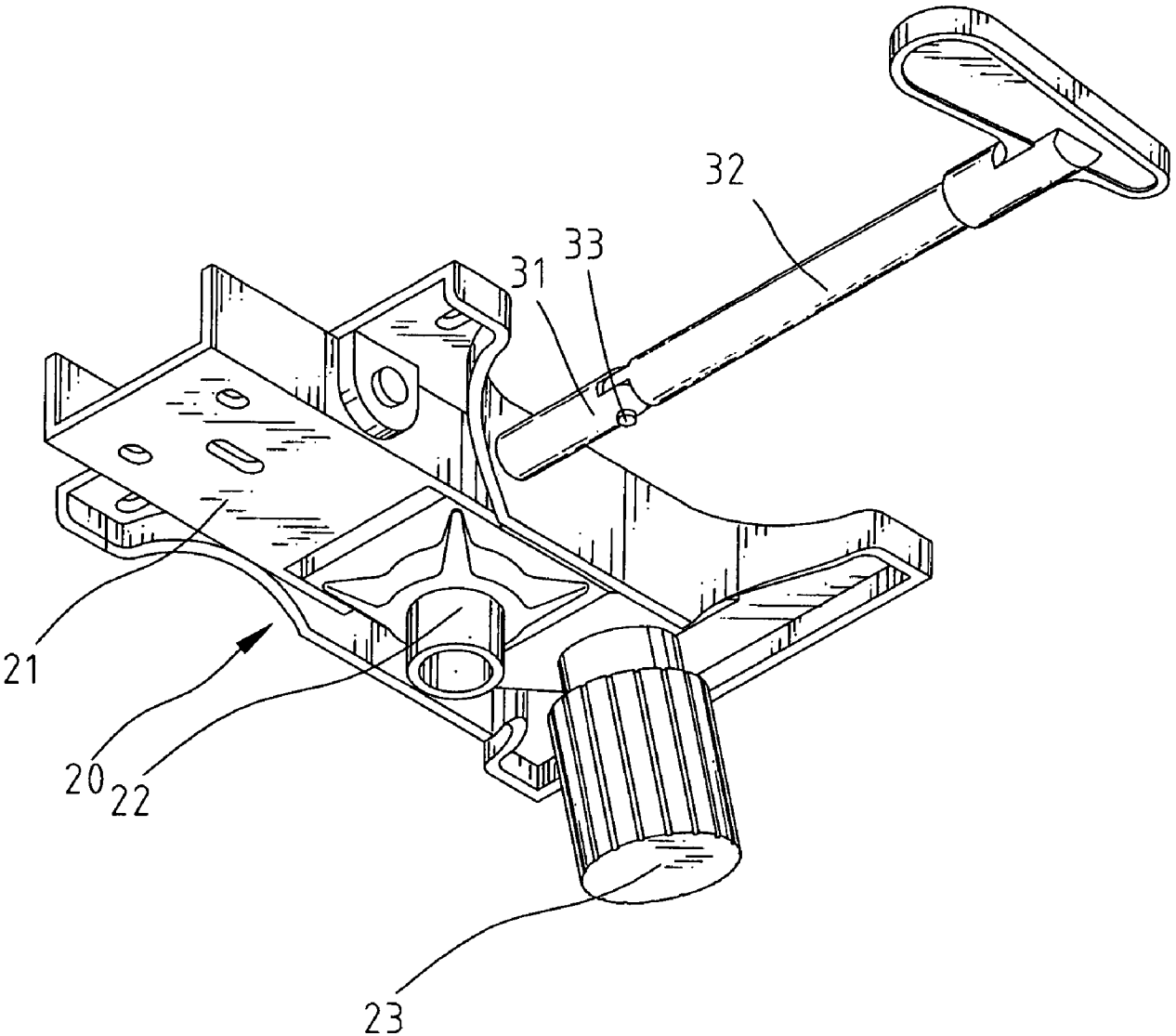
FIG. 2 is an elevational assembly view of the control device according to the first embodiment of the present invention.

Referring to FIGS. 1 and 2, a control device 20 in accordance with a first embodiment of the present invention is shown installed in a chair 10 for swivel or lifting control.

The chair 10 comprises a seat 11, a back 12 for supporting the back of the user sitting on the seat 11, a stand (not shown) and a seat post 111 for supporting the seat 11, and a connecting bar 121, which has a first end fixedly fastened to the bottom side of the back 12 and a second end suspended below the seat 11.

The control device 20 comprises a casing 21 which receives the second end of the connecting bar 121 for enabling the connecting bar 121 to be moved forwards/backwards relative to the casing 21 to adjust the pitch between the back 12 and the seat 11. The control device 20 further includes a vertical barrel 22 which is formed integral with the casing 21 and sleeved onto the seat post 111. The control device also includes a lock 23 adapted to lock the casing 21 to the connecting bar 121, a control rod 31 pivotally mounted in the casing 21, and an operating handle 32 coupled to the control rod 31 for operation by hand to bias the control rod 31 and to further control rotation of the seat 11 with the back 12 on the seat post 111 or lifting of the seat 11 relative to the seat post 111. Because the rotation/lifting control is of the known art and not within the scope of the claims of the present invention, no further detailed description in this regard is necessary.

Figure 3:
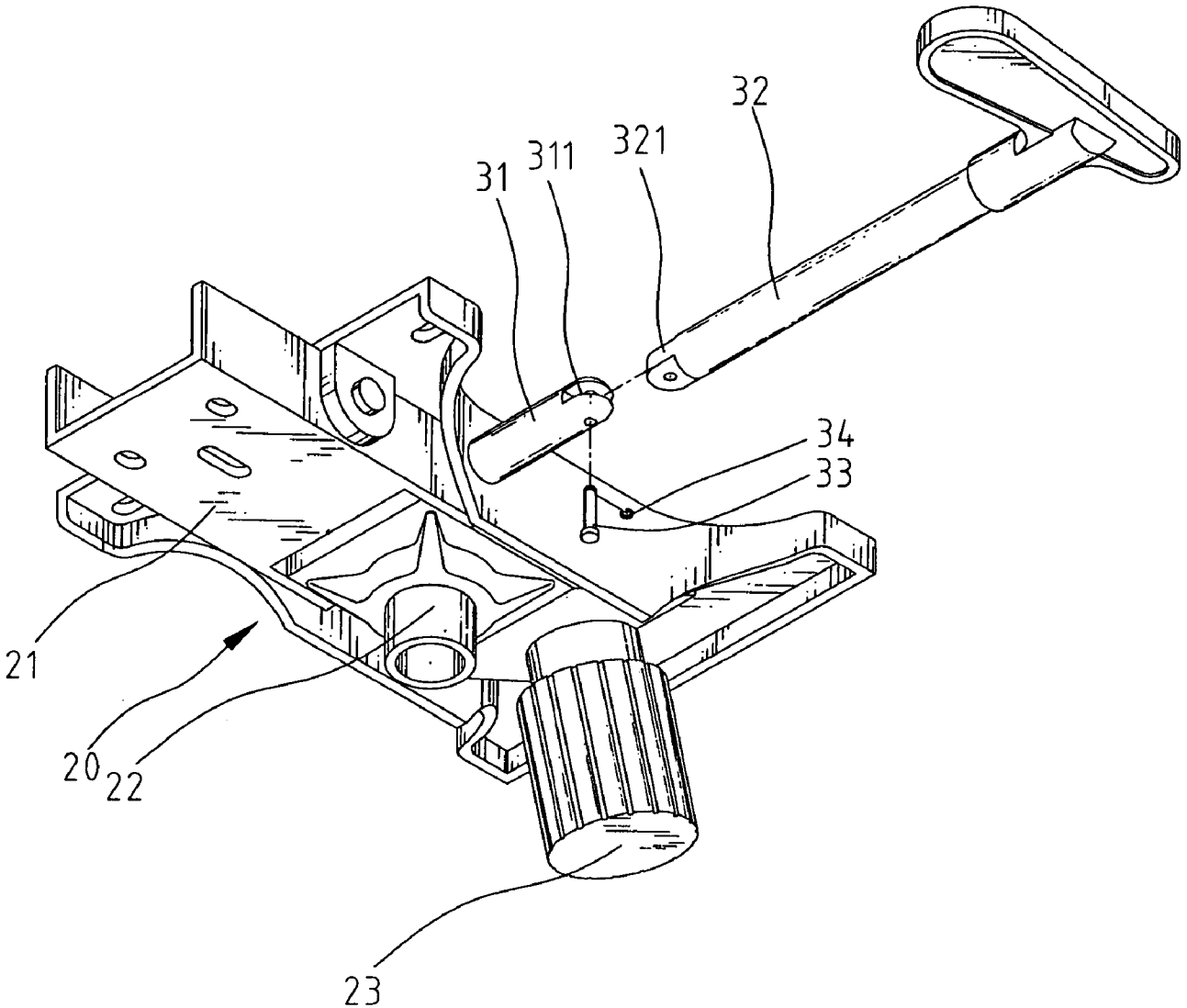
FIG. 3 is an exploded view of the control device according to the first embodiment of the present invention.
Figure 4:
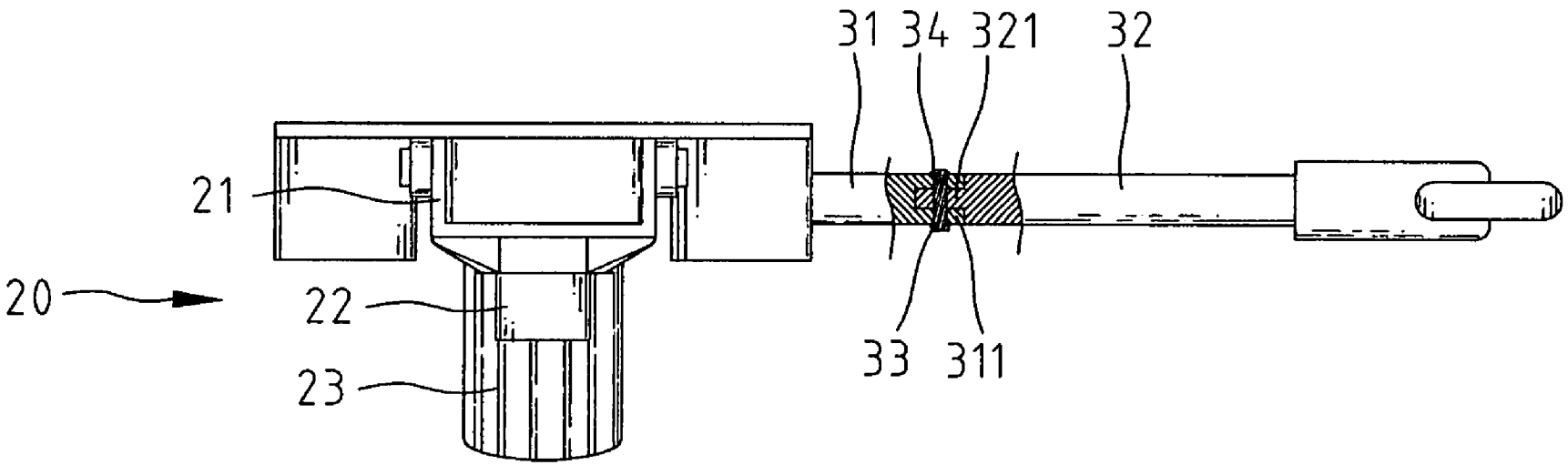
FIG. 4 is a side view, partially in section, of the control device according to the first embodiment of the present invention, showing the screw bolt fastened to the flat end tip of the operating handle and the flat end notch of the control rod.
Figure 5:
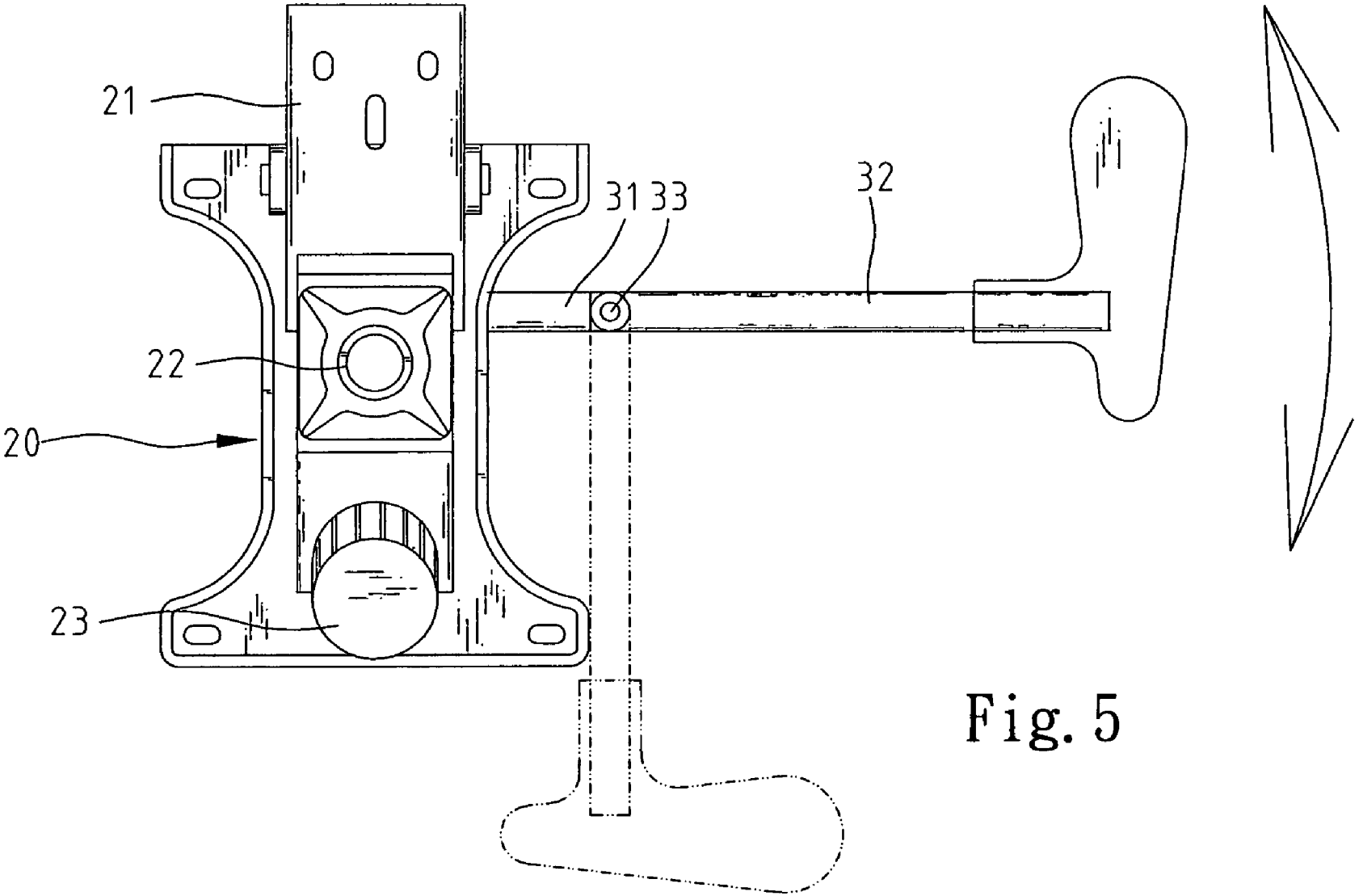
FIG. 5 is a schematic drawing of the first embodiment of the present invention, showing adjustment of the operating handle between the operative position and the non-operative position.

Referring to FIGS. 3~5, the control rod 31 has a flat end notch 311 in the outer end thereof. The operating handle 32 has a flat end tip 321 fitting the flat end notch 311 of the control rod 31 (see FIG. 3). The flat end tip 321 of the operating handle 32 is inserted into the flat end notch 311 of the control rod 31 and pivotally secured thereto by a screw bolt 33 and a spring washer 34 (see FIG. 4). When installed, the user can rotate the operating rod 32 to bias the control rod 31. Further, the operating rod 32 can be turned about the screw bolt 33 between the operative position where the operating rod 32 and the control rod 31 are aligned in a line (see the rear line in FIG. 5) and the non-operative (collapsed) position where the operating rod 32 and the control rod 31 are maintained at right angles to save delivery space (see the imaginary line in FIG. 5).

Figure 6:
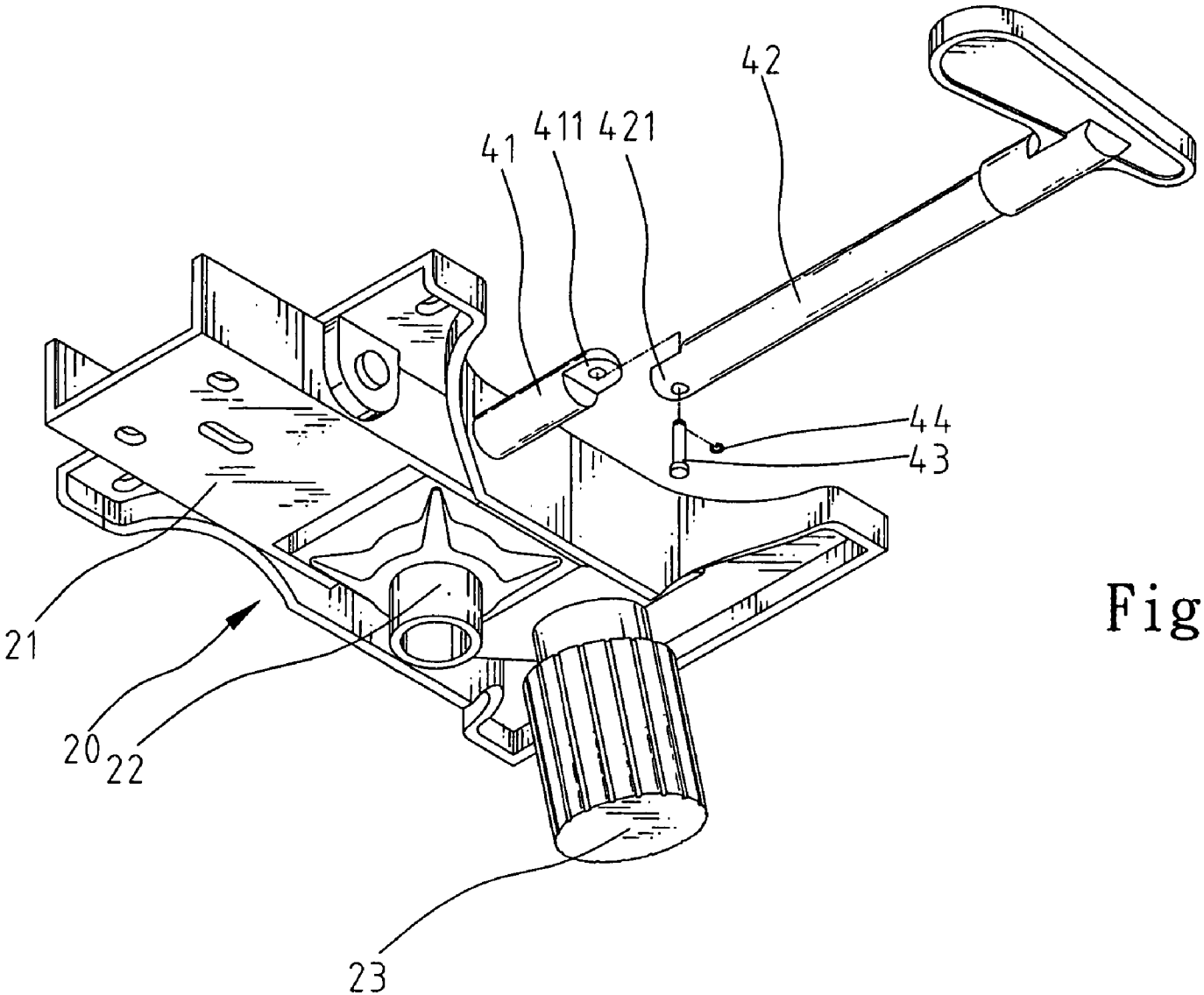
FIG. 6 is an exploded view of a control device according to a second embodiment of the present invention.
Figure 7:
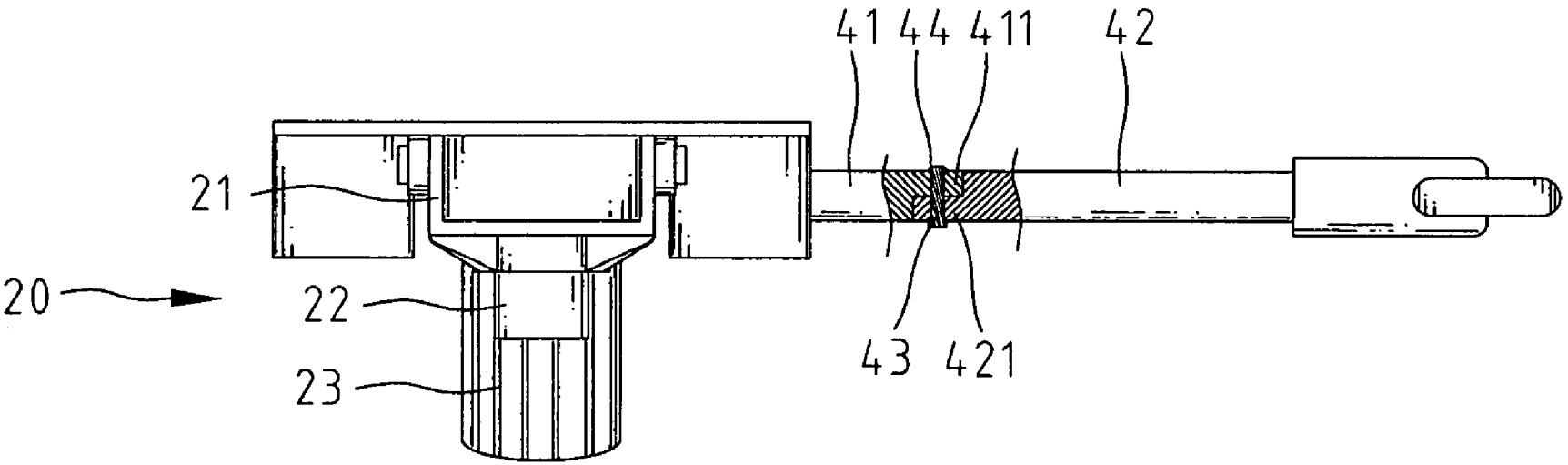
FIG. 7 is a side view, partially in section, of the control device according to the second embodiment of the present invention.

FIGS. 6 and 7 show a control device 20 according to a second embodiment of the present invention. This embodiment is substantially similar to the aforesaid first embodiment with the exception of the connecting structure between the control rod and the operating rod. According to this embodiment, the control rod 41 has an end projection 411 axially projected from the outer end, and the operating handle 42 has an end projection 421 axially projected from one end and fitting the end projection 411 of the control rod 41. A screw bolt 43 is fastened to the end projection 421 of the operating handle 42 and the end projection 411 of the control rod 41 and secured thereto with a spring washer 44 to connect the operating handle 42 to the control rod 41, for enabling the operating handle 42 to be rotated by the user to bias the control rod 41 or turned about the screw bolt 43 between the operative position and the non-operative (collapsed) position.

Figure 8:
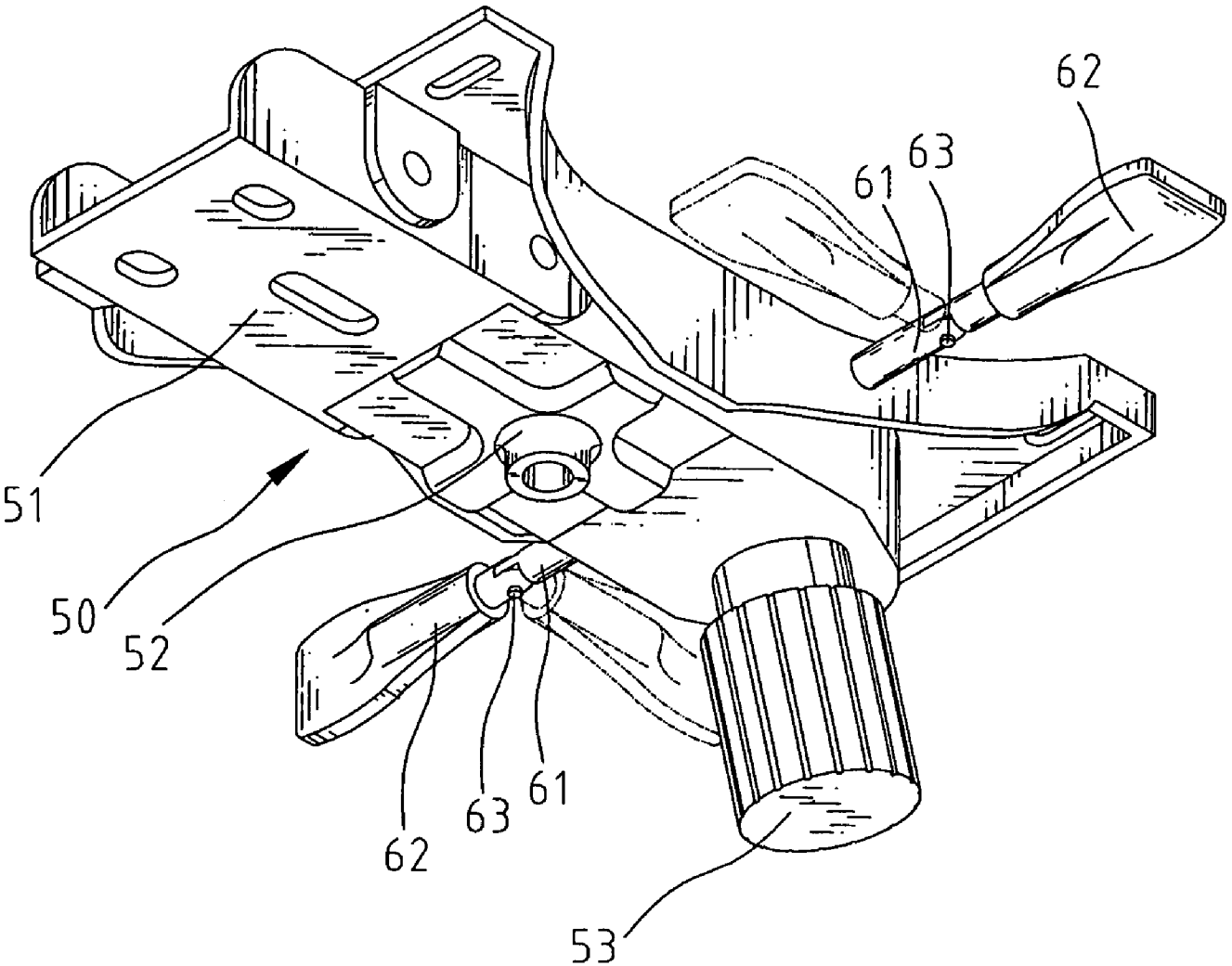
FIG. 8 is an elevational assembly view of a control device according to a third embodiment of the present invention.

FIG. 8 shows a control device 50 according to a third embodiment of the present invention. According to this embodiment, the control device 50 comprises a casing 51, a barrel 52, and a lock 53. The casing 51, the barrel 52 and the lock 53 are substantially similar to like parts in the aforesaid first and second embodiments. The control device 50 further comprises two control rods 61 pivotally installed in the casing 51 at two sides for different function control, and two operating handles 62, respectively, pivotally coupled to the control rods 61 by a respective screw bolt 63. When installed, each operating handle 62 can be rotated to bias the respective control rod 61, or turned about the respective screw bolt 63 relative to the respective control rod 61 between the operative position and the non-operative (collapsed) position.

Figure 9:
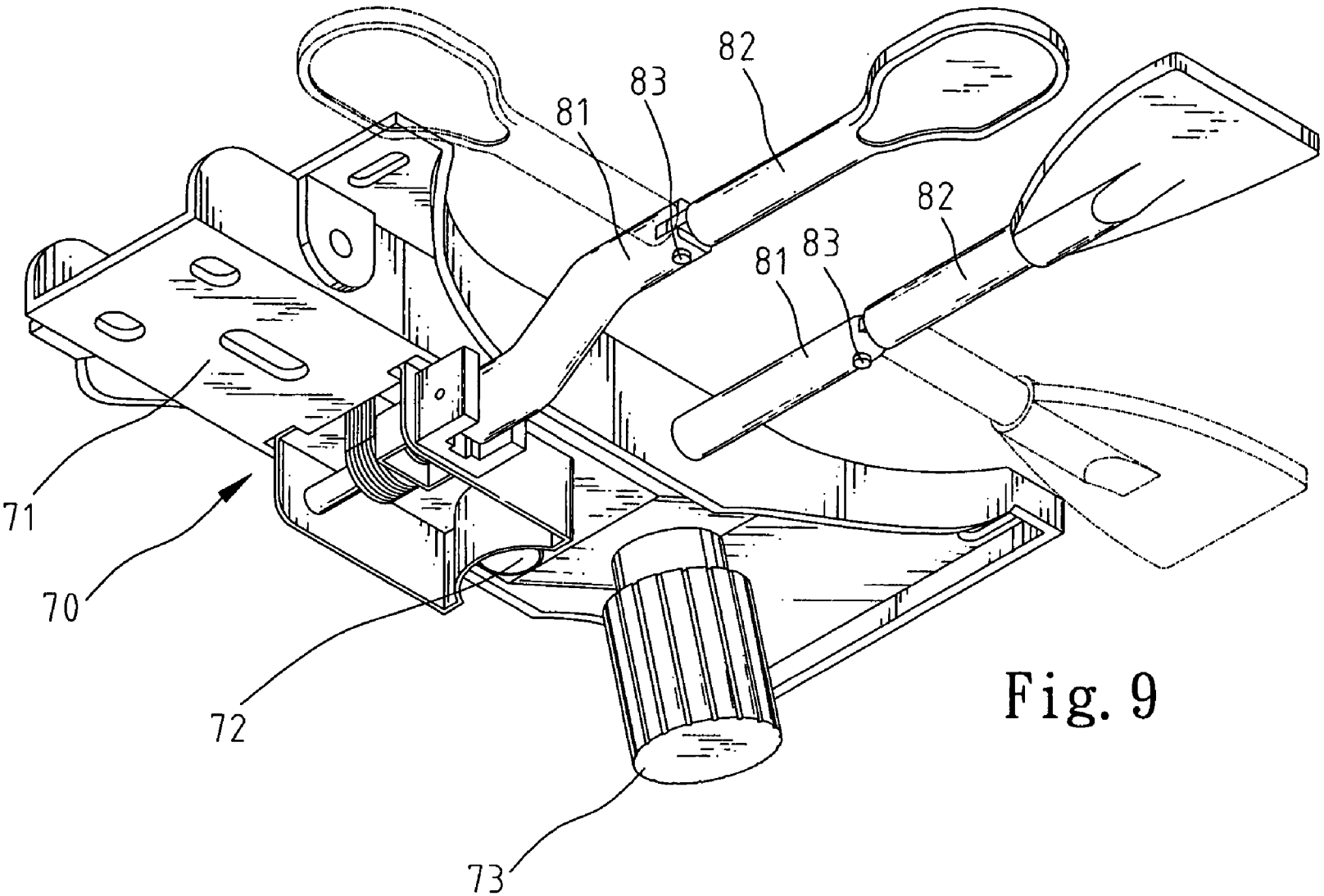
FIG. 9 is an elevational assembly view of a control device according to a fourth embodiment of the present invention.

FIG. 9 shows a control device 70 according to a fourth embodiment of the present invention. According to this embodiment, the control device 70 comprises a casing 71, a barrel 72, and a lock 73. The casing 71, the barrel 72 and the lock 73 are substantially similar to like parts in the aforesaid first, second and third embodiments. The control device 70 further comprises two control rods 81 pivotally installed in the casing 71 at one lateral side for different function control, and two operating handles 82, respectively, pivotally coupled to the control rods 81 by a respective screw bolt 83. When installed, each operating handle 82 can be rotated to bias the respective control rod 81, or turned about the respective screw bolt 83 relative to the respective control rod 81 between the operative position and the non-operative (collapsed) position.

A prototype of control devices 20, 50 an 70 having a collapsible operating handle has been constructed with the features of FIGS. 1~9. The control device 20, 50 or 70 having a collapsible operating handle functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A control device installed in a chair at a bottom side, comprising at least one control rod respectively rotatable by an external force to control a respective functional mechanism of said chair, at least one operating handle respectively pivoted to said at least one control rod for rotation by the user's hand to bias the respective operating rod, and at least one pivot means, respectively, connecting said at least one operating handle to said at least one control rod such that each said operating handle is turnable about the respective pivot means relative to the respective operating rod between a received non-operative position and an extended operative position where each said operating handle is rotatable by the user to bias the respective operating rod.

2. The control device as claimed in claim 1, wherein said at least one control rod includes two control rods disposed at two opposite lateral sides relative to said chair; said at least one operating rod includes two operating rods, respectively, pivotally coupled to the two control rods by said at least one pivot means.

3. The control device as claimed in claim 1, wherein said at least one control rod includes two control rods disposed at one lateral side relative to said chair; said at least one operating rod includes two operating rods, respectively, pivotally coupled to the two control rods by said at least one pivot means.

4. The control device as claimed in claim 1, wherein each said control rod has an outer end terminating in a flat end notch; each said operating handle has one end terminating in a flat end tip fitted into the flat end notch of the respective control rod and pivotally connected thereto by one said pivot means.

5. The control device as claimed in claim 1, wherein each said control rod has an outer end terminating in an end projection; each said operating handle has one end terminating in an end projection fitting the end projection of the respective control rod and pivotally connected to the end projection of the respective control rod by one said pivot means.

6. The control device as claimed in claim 1, wherein the at least one operating handle extends at a nonparallel angle to the at least one control rod in the received non-operative position and extends parallel and contiguous with the at least one control rod in the extended operative position.

* * * * *